US010990039B2

(12) United States Patent
Dayan et al.

(10) Patent No.: US 10,990,039 B2
(45) Date of Patent: Apr. 27, 2021

(54) LAYER THICKNESS IN PRINT AGENT CONCENTRATION APPARATUS

(71) Applicant: HP INDIGO B.V., Amstelveen (NL)

(72) Inventors: Benjamin Dayan, Ness Ziona (IL); Ezra Cohen, Ness Ziona (IL); Marc Klein, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/924,866

(22) Filed: Jul. 9, 2020

(65) Prior Publication Data

US 2020/0341407 A1 Oct. 29, 2020

Related U.S. Application Data

(63) Continuation of application No. 16/603,805, filed as application No. PCT/EP2017/059625 on Apr. 24, 2017, now Pat. No. 10,712,688.

(51) Int. Cl.
*G03G 15/10* (2006.01)

(52) U.S. Cl.
CPC ..... *G03G 15/105* (2013.01)

(58) Field of Classification Search
CPC ..... G03G 15/105
USPC ..... 399/57, 58
See application file for complete search history.

(56) References Cited

U.S. PATENT DOCUMENTS

| | | | |
|---|---|---|---|
| 6,603,934 | B2 | 8/2003 | Shimmura |
| 6,935,734 | B2 | 8/2005 | Askren et al. |
| 7,481,509 | B2 | 1/2009 | Staelin et al. |
| 8,563,210 | B2 | 10/2013 | Chun et al. |
| 9,327,295 | B2 | 5/2016 | Lior |
| 9,375,653 | B2 | 6/2016 | Sandler |
| 10,712,688 | B2 * | 7/2020 | Dayan et al. ..... G03G 15/105 |
| 2001/0016128 | A1 | 8/2001 | Kitoba et al. |
| 2003/0118361 | A1 | 6/2003 | Shimmura |
| 2010/0225991 | A1 | 9/2010 | Birecki et al. |

FOREIGN PATENT DOCUMENTS

WO WO-2013107522 7/2013

OTHER PUBLICATIONS

Hunt, et al.; "A Guideline to Wet and Dry Ink Deposit Measurement Methods", <https://apps.sgia.org/members/sptf_pdfs/wetdry_1.pdf>, 1996.

* cited by examiner

*Primary Examiner* — William J Royer

(74) *Attorney, Agent, or Firm* — Dierker & Kavanaugh PC

(57) ABSTRACT

In an example, a method includes providing a print agent with chargeable particles in a carrier fluid to a print agent concentration apparatus. The print agent may be passed between a conveyor and an electrode, and a potential applied to cause the chargeable particles to be attracted to the conveyor and to form a concentrated layer of particles on the conveyor. An indicator of particle concentration in the concentrated layer may be measured. It may be determined if the indicator of particle concentration meets predetermined criteria.

15 Claims, 6 Drawing Sheets

LAYER THICKNESS IN PRINT AGENT CONCENTRATION APPARATUS

CROSS-REFERENCE TO RELATED APPLICATIONS

This application is a continuation of co-pending U.S. application Ser. No. 16/603,805, filed Oct. 8, 2019, which itself is a national stage entry under 35 U.S.C. § 371 of PCT/EP2017/059625, filed Apr. 24, 2017, each of which is incorporated by reference herein in its entirety.

BACKGROUND

In some examples, it may be intended to remove a carrier fluid from a substance, for example to reduce a liquid volume for transport.

In the field of printing, liquid electrophotography (LEP) technology may be implemented. LEP printing involves the transfer of electrically-charged liquid print agent via a series of rollers to a substrate. The liquid print agent may comprise chargeable particles (which may be pigmented toner particles, for example) suspended in a carrier fluid. In some cases, the carrier fluid may be separated from the particles, for example to reduce bulk for transport or transport. Carrier fluid may then be added again prior to printing.

BRIEF DESCRIPTION OF DRAWINGS

Non-limiting examples will now be described with reference to the accompanying drawings, in which.

DETAILED DESCRIPTION

In a liquid electrophotography (LEP) printing system, print agent, such as ink, coatings and the like is provided in a print agent application assembly. Print agent from a print agent application assembly is selectively transferred, for example from a roller of the print agent application assembly in a layer of substantially uniform thickness to a photoconductive surface. The selective transfer of print agent is achieved through the use of electrically-charged print agent and selectively charging portions of the photoconductive surface.

LEP print agents may be described as 'liquid toners', comprising chargeable particles suspended in a carrier fluid, which is generally substantially non-polar (i.e. non-chargeable), for example comprising an oil.

In some examples, a proportion of the carrier fluid may be removed such that a relatively toner particle rich, or concentrated, print agent is provided. This may for example reduce bulk and cost of transportation, storage and the like. In some examples, the print agent may be remixed relatively locally to a print apparatus (in some examples within a component of the print apparatus itself).

Removal of the carrier fluid may be achieved in various ways, for example using heat to dry the fluid, or centrifugal separation or the like. In some examples herein, separation is achieved by charging the particles and causing the print agent to adhere to a conveyor, in much the same manner as it adheres to a photoconductive surface in printing. Carrier fluid may then be separated out, leaving a more concentrated (i.e. particle rich) print agent.

Figure 1:
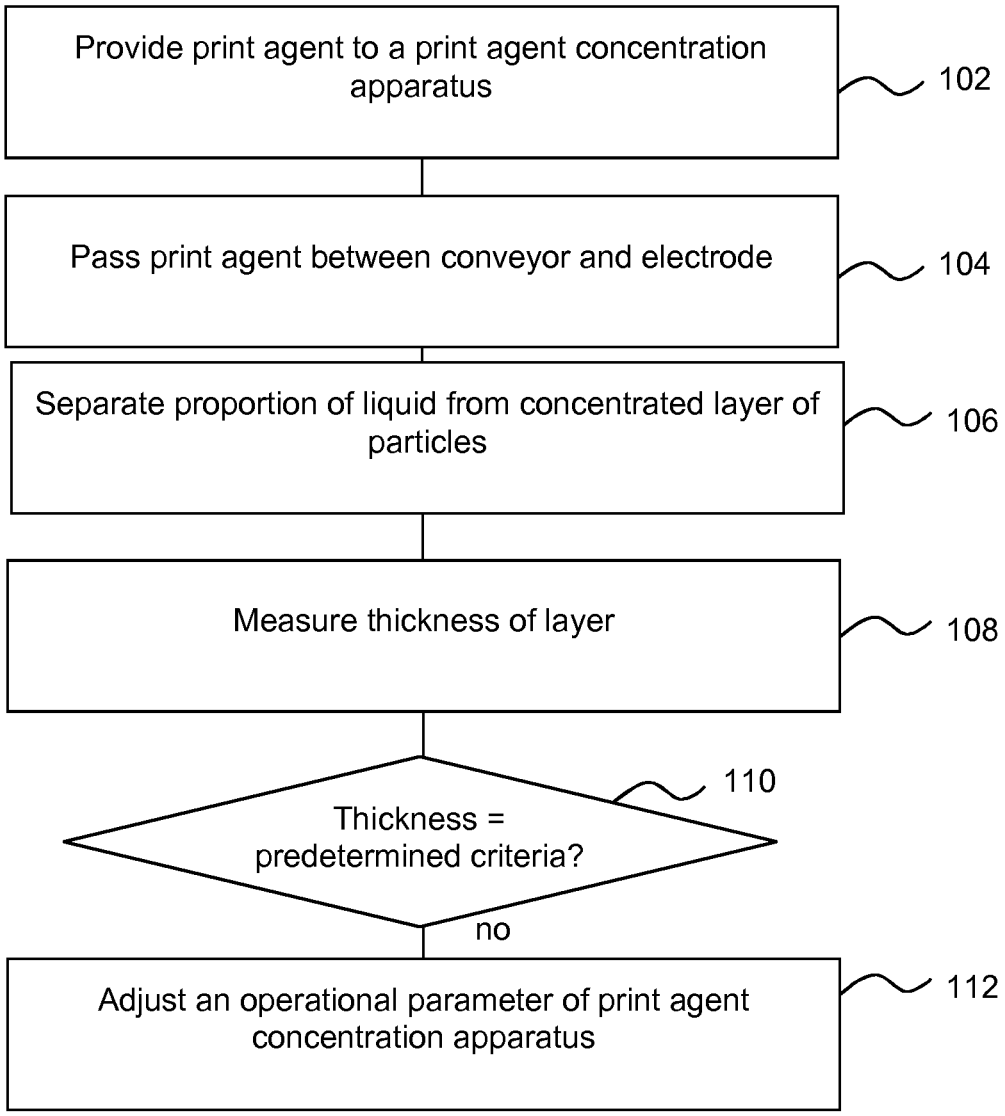
FIGS. 1 and 2 are example methods of providing concentrated print agents.

FIG. 1 is an example of a method, which may comprise a method of providing a concentrated print agent and/or a method of calibrating a print agent concentration apparatus. The method comprises, in block 102, providing a print agent comprising chargeable particles in a carrier fluid to a print agent concentration apparatus. The print agent may be in a 'ready to print' form, for example having a concentration by weight of particles (for example, toner particles) which is suitable for use in a print apparatus, or may be at some other concentration. Block 104 comprises passing the print agent between a conveyor and an electrode, wherein a potential is applied to cause the particles to be attracted to the conveyor and to form a concentrated layer of particles on the conveyor. In other words, the particles tend to move towards the surface of the conveyor by virtue of the applied charges. The particles may become charged, for example.

Block 106 comprises separating a proportion of the carrier fluid from the concentrated layer of particles. This may comprise using the action of gravity: for example, the conveyor may be a drum, which lifts the print agent. The electrostatic force tends to counter the gravitational force, so substantially all the particles may be lifted. However, at least some of the un-charged carrier fluid may fall away. In other examples other method of separations, such as pressure from a squeegee roller (which may itself be charged (and/or serve as the electrode) and/or carry away a proportion of the carrier fluid), application of an air flow in the form of an air knife, or the like may be used.

Block 108 comprises measuring a thickness of the remaining layer (or viewed another way, a particle-rich layer of print agent) on the conveyor. In some examples, this may comprise using ranging apparatus, for example optical (e.g. laser) ranging or distance sensing apparatus. The print agent supplied to the print agent concentration apparatus may be thought of as having a first concentration of particles (for example as determined by the percentage weight solid particles) and the measured layer may be thought of as a layer of print agent having a second concentration, which is higher than the first concentration.

Block 110 comprises determining if the measured thickness of the layer meets predetermined criteria and, if not, the method proceeds to block 112, which comprises adjusting an operational parameter of the print agent concentration apparatus. The criteria may be a thickness or may be a range of thicknesses. The adjustment may be to cause the thickness to tend towards an intended thickness. In some examples, the method may loop back to block 110 after the operational parameter has been adjusted.

Adjusting the operational parameter may for example comprise adjusting an operational parameter which has an effect on layer thickness. For example, this may comprise any, or any combination of a voltage level of the electrode or any other of the voltages within the apparatus, such as the voltage level of a further carrier fluid separation apparatus (e.g. a squeegee roller or the like), a rate of supply of the print agent, a print agent source, and/or a speed of motion of the conveyor. Each of these parameters has been shown to have an effect on the layer thickness, as is further discussed below.

For example, the print agent may be supplied with the Non-Volatile Solid (or NVS) concentration indicative of the amount of toner particles of around 22 to 24 wt %, or may be at a lower concentration, for example, around 2 to 10 wt % whereas following concentration, it may be intended to reach a concentration of around 30 to 40 wt %, or higher.

It has been found that the thickness of the layer may be reliably indicative of the Non-Volatile Solid (or NVS) content of the print agent, with thinner layers being indicative of higher concentrations. Such a correlation may be predetermined and stored in a lookup table or the like (for example on per-print agent as for different print agents (e.g. different colors), the relationship may be different). This therefore allows an estimate of the concentration level of the particle layer to be made while the layer is on the conveyor. This may for example allow for fast and accurate calibration of apparatus: the operational parameters which result in an intended layer thickness (in some examples, for a particular print agent), and therefor layer concentration, may be stored and used in subsequent operations. In some examples, a feedback loop may be instigated, and at least one parameter may be adjusted in response to any departure from an intended thickness (for example due to a dirty or aged component, or environmental conditions, or the like), thus providing a more consistent output.

The method may further comprise removing the concentrated print agent from the conveyor. This may be carried out substantially continuously, for example in the case of the conveyor being a rotating drum, a cycle of applying print agent to the drum and removing (for example by scraping) the concentrated print agent from the drum may be carried out within a single drum rotation, and the drum may continue rotating until an intended amount of concentrated print agent has been removed from the drum.

Figure 2:
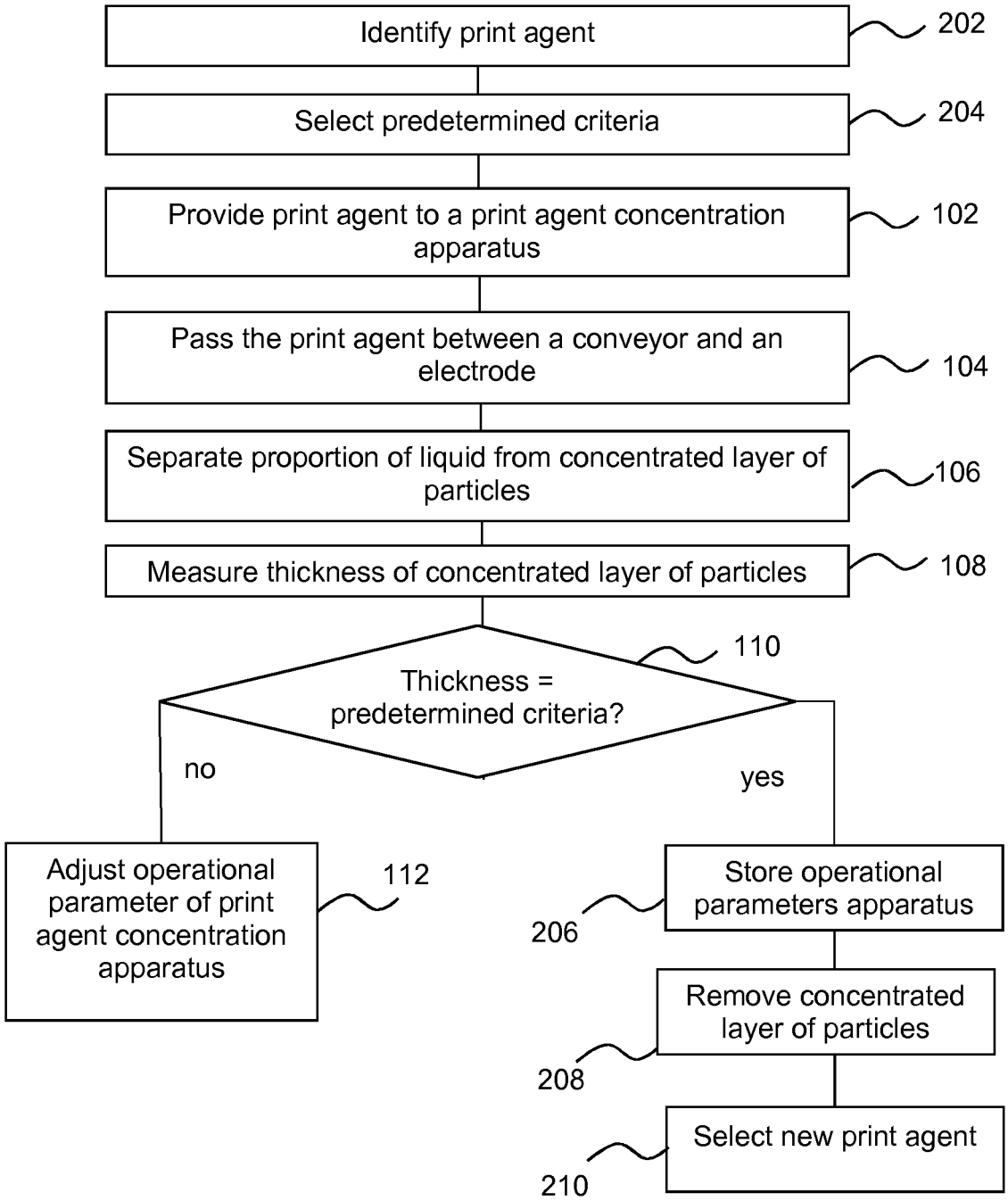

FIG. 2 is an example of a method comprising, in block 202, determining a print agent type. For example, this may comprise a color, a print agent source (for example, a manufacturer, or a factory), or any other detail or combinations of details of the print agent.

In block 204, the predetermined criteria is selected based on the print agent type. An intended concentration may be selected based on the agent and, even if the intended concentration is the same, the thickness of the print agent layer associated with that concentration may vary between print agent types. Each print agent may for example be associated with a particular look up table.

The method then proceeds with the blocks of FIG. 1. The method may loop back to measuring the thickness of the layer after the operational parameters have been adjusted, and further comprises, in block 206, if it is determined in block 110 that the measured thickness of the layer does meet the predetermined criteria (e.g. the thickness is within a predetermined range, or substantially a particular value), storing the operational parameters. The parameters may be stored in association with the print agent type. Block 208 comprises removing the particle-rich layer from the conveyor. Block 210 comprises selecting a new print agent, and the method may then repeat from block 202.

The method of FIG. 2 therefore allows the operational parameters resulting in an intended print agent thickness to be determined and stored for a plurality of print agent types. This may for example allow calibration of a print agent concentration apparatus for the tested print agents, and/or corrections of a layer thickness in use of the apparatus (for example so as to tend towards an intended layer thickness/concentration).

FIGS. 3A-3E are examples showing how the operational parameters affect the concentration of particles in print agent removed from an apparatus (NVS wt % residual).

Figure 3A:
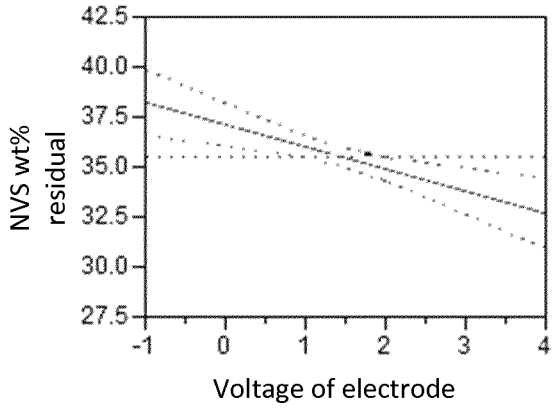
FIG. 3A-3E illustrate example relationships between operational parameters of a print agent concentration apparatus and concentration of particles.
Figure 3B:
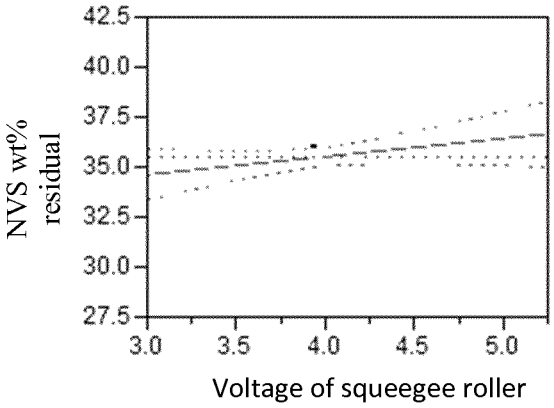
Figure 3C:
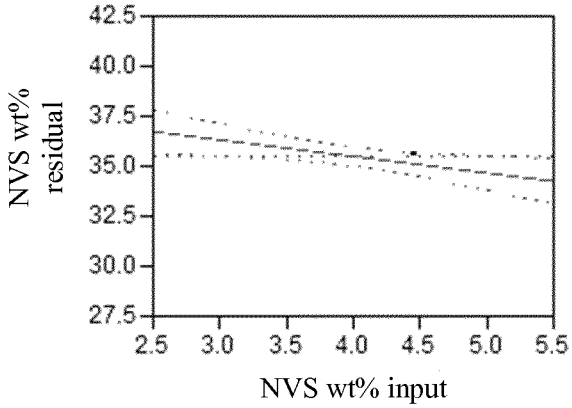
Figure 3D:
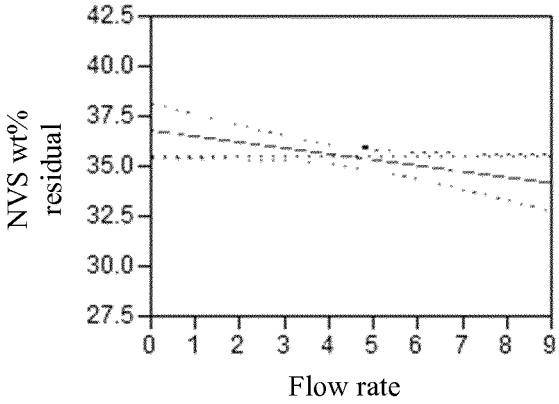
Figure 3E:
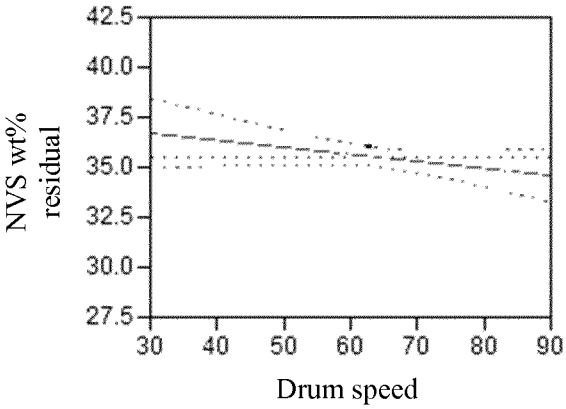

From FIG. 3A, it may be seen that as the electrode potential (measured in Kilovolts) is reduced, the layer concentration increases. From FIG. 3B, it may be seen that, for a first squeegee roller, increasing the potential of the roller increases the concentration as it urges the particles away from the squeegee roller and towards the conveyor. From FIG. 3C, it may be seen that, as the concentration of the particles within a supplied print agent reduces, the concentration of the layer formed increases. FIGS. 3D and 3E show how decreasing a flow rate at which print agent is supplied to the concentration apparatus and decreasing the speed of rotation of a drum providing the conveyor can both increase the concentration of the layer formed.

Figure 4:
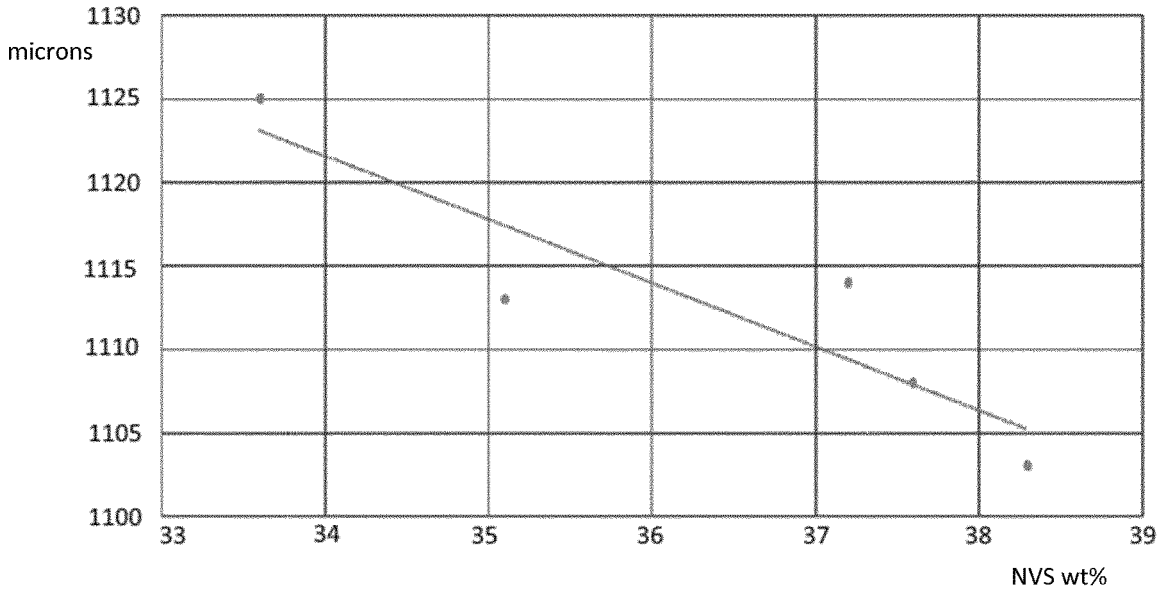
FIG. 4 illustrates an example relationship between layer thickness and particle concentration.

FIG. 4 is an example of a relationship between a measured layer thickness and the measurement of the NVS content. This may be used, for example in the form of a lookup table or as a mathematical operator, to convert a layer thickness to an NVS estimate, or to determine an intended layer thickness given an intended concentration. In this example, the relationship is roughly linear although this need not always be the case.

Figure 5:
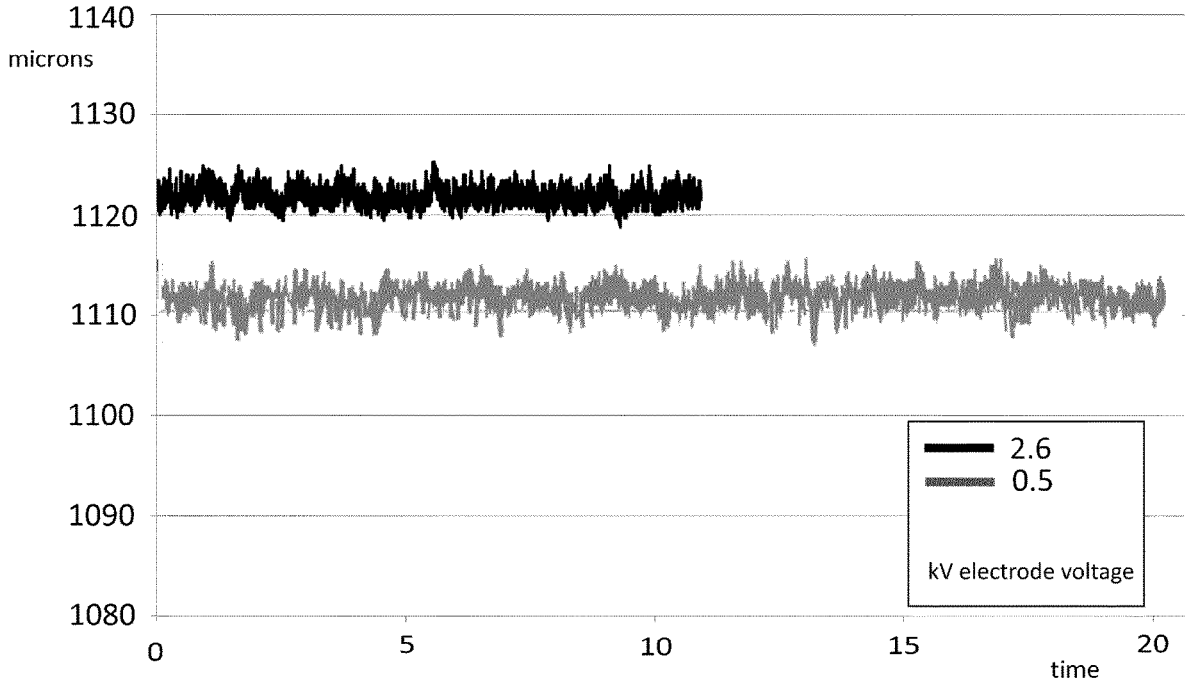
FIG. 5 illustrates an example relationship between layer thickness and an operational parameter.

FIG. 5 is an example of how the layer thickness changes according to a changing electrode potential. In this example, a reduction from 2.6 KV to 0.5KV corresponds to an reduction in layer thickness of about 10 microns, which in turn relates to a change from a NVS of around 33.6 wt % to around 37.2 wt %.

Figure 6:
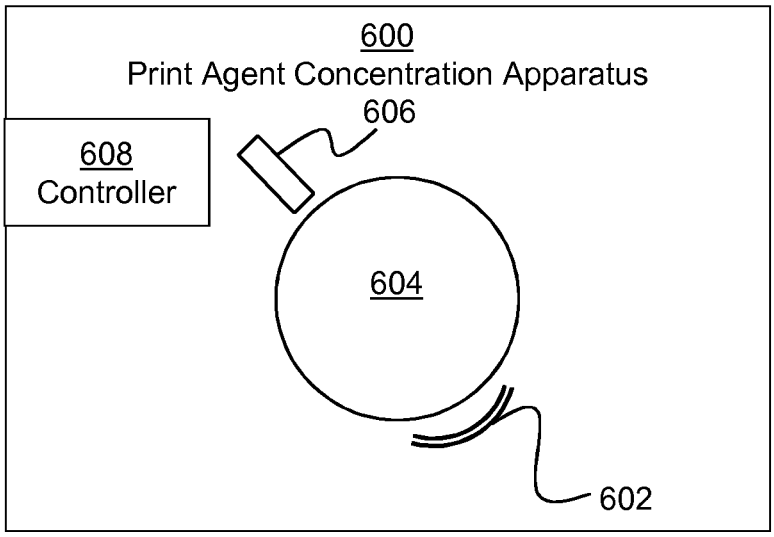
FIGS. 6 and 7 are schematic drawings of example print agent concentration apparatus.

FIG. 6 is an example of a print agent concentration apparatus 600 comprising an electrode 602, a conveyor 604, a distance sensor 606 and a controller 608.

In this example, the electrode 602 follows the shape of the exterior of the conveyor 604, which is a drum.

In use of the apparatus 600, the electrode 602 applies a first potential to a print agent comprising chargeable particles in a carrier fluid which may be introduced between the electrode 602 and the conveyor 604 such that, by virtue of the applied first potential, the particles are attracted to a surface of the conveyor 604. The conveyor 604 carries a concentrated layer of the particles away from a proportion of the carrier fluid, for example by lifting the fluid under gravity such that at least some of the carrier fluid falls away while the particles are held by electrostatic forces.

While in this example a drum is shown, the conveyor 604 may be any suitable conveyor that can support and move the print agent for the electrostatic printing process, and to which the print agent may be attracted. When charged, i.e. when a potential is applied between the conveyor 604 and the electrode 602, the conveyor 604 is adapted so that the chargeable particles adhere to the conveyor 604.

The conveyor 604 may have a continuous surface that forms a loop, for example comprising a drum or a belt. The conveyor 604 may comprise a metal, for example as a surface or as a substrate below a non-metallic (e.g. elastomeric) surface and may be of any suitable size, for example being of between 40 cm and 2 m in cylinder length. In some examples, the conveyor 604 is mounted such that the speed of rotation may be controlled by controller 608.

The electrode 602 can be any suitable electrode capable of applying a potential between the chargeable conveyor and the electrode. The electrode 602 may be stationary relative to the conveyor 604 and may have a shape that, at least in part, corresponds to the shape of at least part of the conveyor 604 (in this example having a curve from following a portion of the circumference of the conveyor's surface). The electrode 602 may comprise any electrically conducting material, for example a metal or carbon.

The distance between the electrode 602 and the conveyor 604 may be around 0.5 to 5 mm and the applied potential may be around −500 V up to 7 KV. In some examples, the applied potential may be around −500 V to up to 5 KV. The applied potential may be controlled by the controller 608.

The distance sensor 606 is operable to sense a distance to the surface of the layer of particles on the conveyor 604 (for example so as to determine the thickness of a layer thereon). The controller 608 controls an operational parameter of the print agent concentration apparatus 600 based on the distance. For example, this may be so as to achieve an intended layer thickness, bearing in mind that the distance sensor will measure a shorter distance as the layer thickness increases.

Figure 7:
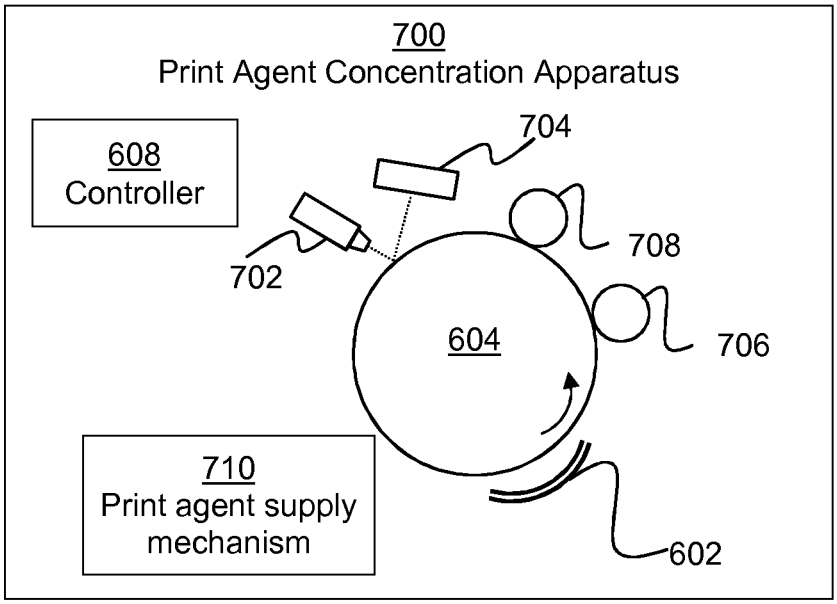

FIG. 7 shows another example of a print agent concentration apparatus 700, in which parts in common with the print agent concentration apparatus 600 of FIG. 6 are labelled with like numbers. In this example, the distance sensor 606 comprises a laser ranging apparatus (or laser distance sensor), comprising a laser source 702 and a sensor 704. The sensor 704 may for example comprise a sensor which detects the location of the laser light (represented as a dotted line) incident thereon, for example comprising a CMOS array. The position of the light is indicative of the range to the 'target' (i.e. the surface of the concentrated print agent layer), and changes in location are indicative of changes to the thickness.

The print agent concentration apparatus 700 further comprises a first and a second squeegee roller 706, 708, which apply a second potential and third potential respectively to the print agent so as to further concentrate the layer of particles, and to carry away a further proportion of the carrier fluid, wherein controller 608 is to control second and third potentials, for example based on the measured distance.

The apparatus 700 passes the print agent on the conveyor 604 past the squeegee rollers 706, 708, wherein the print agent contacts the squeegee rollers 706, 708 and a potential is applied between the conveyor 604 and the squeegee rollers 706, 708, such that the chargeable particles are disposed to move toward the conveyor 604 and some of the carrier fluid is transferred to the squeegee rollers 706, 708 to increase the concentration of the particles in the carrier fluid remaining on the conveyor 604 to leave a concentrated print agent on the conveyor 604.

In other words, the squeegee rollers 706, 708 in this example are able to be biased, such that a potential can be applied between the squeegee rollers 706, 708 and the conveyor 604. The squeegee rollers 706, 708 may comprise a metal, in some examples having a surface covering comprising an elastomeric material. For example, the squeegee rollers 706, 708 may each comprise a drum having a metal core with an outer surface layer comprising an elastomeric material. In some examples, varying a potential on the first squeegee roller 706 may have a greater effect than varying a potential on the second squeegee roller 708. This may be because the print agent is already relatively concentrated by the time it encounters the second squeegee roller 708.

The surface of the conveyor 604 and the squeegee rollers 706, 708 may travel at the same relative speed and in the same direction at the point where they are closest to one another. The surface of the conveyor 604 and the squeegee rollers 706, 708 may travel at a speed of from 1 to 100 cm/sec, or from 10 to 30 cm/sec, which may be controlled by the controller 608.

Applying a potential between the conveyor 604 and the squeegee rollers 706, 708 means that the chargeable particles are disposed to move toward the conveyor 604. Moreover, some of the carrier fluid transfers to the squeegee roller 706, 708 and is removed to increase the concentration of the chargeable particles in the carrier fluid on the conveyor 604 to form a concentrated print agent on the conveyor 604. The potential applied between the conveyor 604 and the squeegee rollers 706, 708 may be less than that applied between the electrode 602 and the chargeable conveyor. The potential applied between the conveyor 604 and the squeegee rollers 706, 708 may be in the range of from 300 to 6000V, or in the range 500-6000 kV, and/or may be controlled by the controller 608.

In other examples, there may be more or fewer squeegee rollers 706, 708 disposed around the conveyor 604. The function of the squeegee rollers 706, 708 could in other examples be fulfilled by moving belts.

The print agent concentration apparatus 700 further comprises a print agent supply mechanism 710, which may for example comprise a pump, valve or the like. The controller 608 may control a rate at which print agent is supplied by the print agent supply mechanism 710 based on the distance measured by the distance sensor 606.

In some examples, the controller 608 produces an alert if the distance does not conform to predetermined parameters. This could be an audible or visual alert, and may be produced locally or at a distance. This may allow an error state to be detected in a calibrated apparatus. In some examples, the print agent concentration apparatus 600, 700 may carry out any of the blocks described in relation to FIGS. 1 and 2 above.

Figure 8:
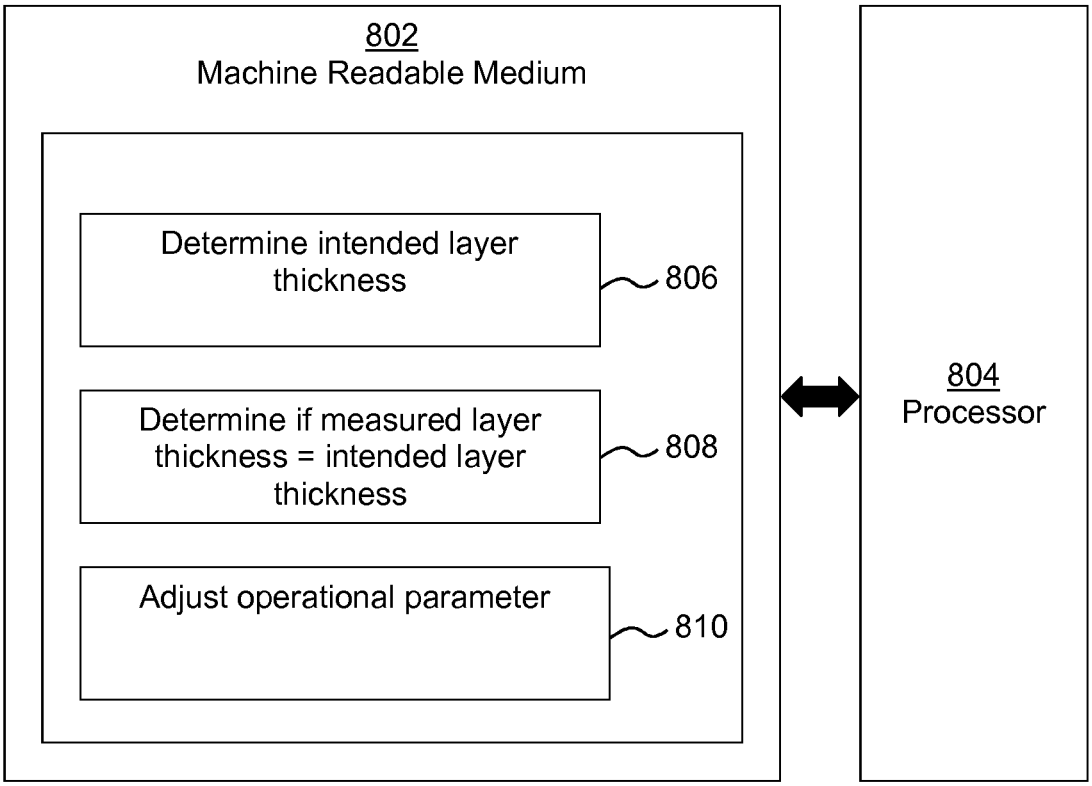
FIG. 8 is an example of a machine readable medium in conjunction with a processor.

FIG. 8 is an example of a machine readable medium 802 in association with a processor 804. The machine readable medium 802 stores instructions which, when executed by the processor 804 cause the processor 804 to carry out certain processes. In this example, the instructions comprise: (i) instructions 806 to, based on an indication of a print agent type, determine an intended layer thickness for a concentrated layer of toner particles, (ii) instructions 808 to, based on an indication of a distance received from a distance sensor, determine if a measured layer thickness is the intended layer thickness, and (iii) instructions 810 to, if the measured layer thickness is not the intended layer thickness determine a parameter adjustment of a print agent concentration apparatus such that the layer thickness tends toward the intended layer thickness.

In some examples, the machine readable medium 802 may further comprise instructions which, when executed by the processor 804 cause the processor 804 to, when the measured layer thickness is the intended layer thickness, store at least one current operational parameter of the print agent concentration apparatus.

The machine readable medium 802 may further comprise instructions to carry out any of the blocks described in relation to FIGS. 1 and 2 above. The machine readable medium 802 and the processor 804 may provide the controller 608 described in relation to FIG. 6 or FIG. 7.

Examples in the present disclosure can be provided as methods, systems or machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that at least blocks in the flow charts block diagrams, as well as combinations thereof can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices (such as the controller 608) may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A method comprising:

providing a print agent with chargeable particles in a carrier fluid to a print agent concentration apparatus;

passing the print agent between a conveyor and an electrode, wherein a potential is applied to cause the particles to be attracted to the conveyor and to form a concentrated layer of particles on the conveyor;

measuring an indicator of particle concentration in the concentrated layer; and determining if the indicator of particle concentration meets predetermined criteria.

2. The method of claim 1, further comprising:

if the indicator of particle concentration does not meet the predetermined criteria, adjusting an operational parameter of the print agent concentration apparatus.

3. The method of claim 2, wherein adjusting the operational parameter comprises adjusting at least one of:

a voltage level of the electrode;

a voltage level of a carrier fluid separation apparatus;

a rate of supply of the print agent;

a print agent source; and a speed of motion of the conveyor.

4. The method of claim 1, wherein the indicator of particle concentration is thickness of the concentrated layer of particles.

5. The method of claim 1, wherein measuring the indicator of particle concentration comprises measuring the thickness using a laser distance sensor.

6. The method of claim 1, further comprising:

determining a print agent type; and selecting the predetermined criteria based on the print agent type.

7. The method of claim 6, wherein the method is carried out for each of a plurality of print agents.

8. The method of claim 1, further comprising:

producing an alert if the indicator of particle concentration does not meet the predetermined criteria.

9. Print agent concentration apparatus comprising:

an electrode, a conveyor, a distance sensor and a controller;

wherein the electrode is configured to apply a first potential to a print agent comprising chargeable particles in a carrier fluid such that the particles are attracted to a surface of the conveyor;

wherein the sensor is configured to determine particle concentration on the surface of the conveyor; and wherein the controller is configured to control an operational parameter of the print agent concentration apparatus based on the particle concentration on the surface of the conveyor.

10. The print agent concentration apparatus of claim 9, wherein the sensor is a distance sensor configured to measure a distance indicative of thickness of a layer of chargeable particles on the surface of the conveyer, and wherein thickness of the layer of chargeable particles on the surface of the conveyer corresponds to particle concentration on the surface of the conveyor via a look-up table.

11. The print agent concentration apparatus of claim 9, wherein the controller is configured to control speed of movement of the conveyer such that the particle concentration on the surface of the conveyor tends toward an intended particle concentration.

12. The print agent concentration apparatus of claim 9, wherein the controller is configured to control the first potential such that the particle concentration on the surface of the conveyor tends toward an intended particle concentration.

13. The print agent concentration apparatus of claim 9, further comprising a print agent supply mechanism, wherein the controller is configured to control a rate at which print agent is supplied such that the particle concentration on the surface of the conveyor tends toward an intended particle concentration.

14. A machine readable medium storing instructions which, when executed by a processor cause the processor to:

based on an indication of a print agent type, determine thickness criteria for a layer of toner particles having a particle concentration meeting concentration criteria; and based on an indication of a distance received from a distance sensor, determine if a measured layer thickness meets the thickness criteria.

15. A machine readable medium according to claim 14 further comprising instructions which, when executed by a processor cause the processor to:

determine a parameter adjustment of a print agent concentration apparatus such that the layer thickness tends toward an intended layer thickness if the measured layer thickness does not meet the thickness criteria.

* * * * *